US012650127B2

(12) United States Patent
Sugahara et al.

(10) Patent No.: US 12,650,127 B2
(45) Date of Patent: Jun. 9, 2026

(54) CO-ROTATING SCROLL COMPRESSOR WITH INVERTER MOUNTED TO REDUCE NOISE

(71) Applicant: KABUSHIKI KAISHA TOYOTA JIDOSHOKKI, Kariya (JP)

(72) Inventors: Akito Sugahara, Kariya (JP); Kazunari Honda, Kariya (JP); Yuji Hashimoto, Kariya (JP); Hiroyuki Kobayashi, Kariya (JP); Yosuke Inagaki, Kariya (JP); Keishiro Muto, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/850,421

(22) PCT Filed: Feb. 14, 2023

(86) PCT No.: PCT/JP2023/005061
§ 371 (c)(1),
(2) Date: Sep. 24, 2024

(87) PCT Pub. No.: WO2023/188917
PCT Pub. Date: Oct. 5, 2023

(65) Prior Publication Data

US 2025/0215876 A1 Jul. 3, 2025

(30) Foreign Application Priority Data

Mar. 31, 2022 (JP) ..... 2022-058153

(51) Int. Cl.
*F04C 18/02* (2006.01)

(52) U.S. Cl.
CPC ..... *F04C 18/023* (2013.01); *F04C 18/0269* (2013.01); *F04C 2240/30* (2013.01); *F04C 2240/40* (2013.01); *F04C 2240/808* (2013.01)

(58) Field of Classification Search
CPC ..... F04C 18/023; F04C 18/0269; F04C 2240/30; F04C 2240/40; F04C 2240/808
See application file for complete search history.

(56) References Cited

U.S. PATENT DOCUMENTS 4,781,550 A * 11/1988 Morishita ..... F04C 18/023 418/55.6
5,632,611 A * 5/1997 Sekiya ..... F04C 18/023 418/55.1

(Continued)

FOREIGN PATENT DOCUMENTS

JP 2002-310073 A 10/2002

OTHER PUBLICATIONS

International Search Report for International Application No. PCT/JP2023/005061 dated Apr. 4, 2023.

(Continued)

*Primary Examiner* — Mary A Davis
(74) *Attorney, Agent, or Firm* — Sughrue Mion, PLLC

(57) ABSTRACT

A co-rotating scroll compressor includes: a driving scroll; a driven scroll, and an inverter circuit disposed on an outer peripheral surface of a housing. On an imaginary plane perpendicular to a driving axis of the driving scroll, a compressive load is generated in a radial direction of the driving scroll. A direction perpendicular to an imaginary line connecting a first contact point and a second contact point at which a driving scroll body comes in contact with a driven scroll body in outermost peripheral portions of the scroll bodies serves as a load direction of the compressive load. The load direction changes within a change range while the driving scroll and the driven scroll make one rotation. The (Continued)

inverter circuit is arranged avoiding the change range in a circumferential direction of the driving scroll.

2 Claims, 11 Drawing Sheets

(56) References Cited

U.S. PATENT DOCUMENTS

| | | | | |
|---|---|---|---|---|
| 7,179,068 | B2 * | 2/2007 | Makino | F04C 23/008 417/410.5 |
| 2002/0150485 | A1 | 10/2002 | Mori et al. | |
| 2019/0203709 | A1 * | 7/2019 | Her | F04C 29/023 |

OTHER PUBLICATIONS

Written Opinion of the International Searching Authority for International Application No. PCT/JP2023/005061 dated Apr. 4, 2023.

* cited by examiner

IMMEDIATELY BEFORE DRIVING
SCROLL IS ROTATED 360 DEGREES

CO-ROTATING SCROLL COMPRESSOR WITH INVERTER MOUNTED TO REDUCE NOISE

CROSS-REFERENCE TO RELATED APPLICATIONS

This application is a National Stage of International Application No. PCT/JP2023/005061 Feb. 14, 2023, claiming priority based on Japanese Patent Application No. 2022-058153 filed Mar. 31, 2022, the contents of all of which are incorporated herein by reference in their entirety.

TECHNICAL FIELD

The present disclosure relates to a co-rotating scroll compressor.

BACKGROUND ART

Patent Literature 1 discloses a known co-rotating scroll compressor (hereinafter simply referred to as a compressor). The compressor includes a driving mechanism, a driving scroll, a driven mechanism, a driven scroll, and a housing having a cylindrical shape.

The driving mechanism includes an electric motor in the housing. The driving scroll is accommodated in the housing and driven rotatably about a driving axis by the driving mechanism. The driven scroll is accommodated in the housing, eccentric to the driving scroll, and driven by the driving scroll and the driven mechanism rotatably about a driven axis to follow the driving scroll.

The driving scroll has a driving scroll end plate and a driving scroll body. The driving scroll end plate extends in a direction intersecting the driving axis. The driving scroll body protrudes from the driving scroll end plate toward the driven scroll, and has a spiral shape.

The driven scroll has a driven scroll end plate and a driven scroll body. The driven scroll end plate extends in a direction intersecting the driven axis. The driven scroll body protrudes from the driven scroll end plate toward the driving scroll, and has a spiral shape.

The driving scroll body and the driven scroll body face each other to form a compression chamber, and the driving scroll and the driven scroll change the volume of the compression chamber by the rotational driving of the driving scroll and the rotational following of the driven scroll.

CITATION LIST

Patent Literature

Patent Literature 1: Japanese Patent Application Publication No. 2002-310073

SUMMARY OF THE INVENTION

Technical Problem

While the compressor is in operation, refrigerant is compressed in the compression chamber and a compressive load is therefore generated. The compressive load acts primarily in the radial direction of the driving scroll rather than in the direction of the driving axis of the driving scroll. The compressive load acting in the radial direction of the driving axis may act on the housing via components, such as bearings, that support the driving scroll and the driven scroll, thereby causing the housing to vibrate.

In the above-mentioned known compressor, the vibration of the housing caused by such a compressive load is not considered problematic. However, for example, if an inverter circuit for driving the electric motor is disposed on the outer peripheral surface of the housing to prevent an increase in the size of the compressor in the direction of the driving axis, a thin case accommodating the inverter circuit and an inverter board may amplify the vibration of the housing, and therefore may increase the noise.

The present disclosure, which has been made in light of the above described circumstance, is directed to providing a co-rotating scroll compressor that includes an inverter circuit on an outer peripheral surface of a housing of the co-rotating scroll compressor and is capable of suppressing vibration and noise caused by a compressive load acting in a radial direction of a driving scroll.

Solution to Problem

A co-rotating scroll compressor according to the present disclosure comprises:

- a driving mechanism; a driving scroll; a driven mechanism; a driven scroll; and a housing having a cylindrical shape,
- wherein the driving scroll is accommodated in the housing and driven rotatably about a driving axis of the driving scroll by the driving mechanism,
- wherein the driven scroll is accommodated in the housing, eccentric to the driving scroll, and follows the driving scroll rotatably about a driven axis of the driven scroll by the driving scroll and the driven mechanism,
- wherein the driving scroll has: a driving scroll end plate extending in a direction intersecting the driving axis; and a driving scroll body protruding from the driving scroll end plate toward the driven scroll and having a spiral shape,
- wherein the driven scroll has: a driven scroll end plate extending in a direction intersecting the driven axis; and a driven scroll body protruding from the driven scroll end plate toward the driving scroll and having a spiral shape,
- wherein the driving scroll and the driven scroll face each other, the driving scroll body and the driven scroll body forming a compression chamber, the driving scroll and the driven scroll being configured to change a volume of the compression chamber by rotational driving of the driving scroll and rotational following of the driven scroll,
- wherein the driving mechanism includes: an electric motor accommodated in the housing; and an inverter circuit for driving the electric motor, the inverter circuit being disposed on an outer peripheral surface of the housing,
- wherein on an imaginary plane perpendicular to the driving axis,
  - a midpoint between a center of a driving scroll base circle of the driving scroll body and a center of a driven scroll base circle of the driven scroll body serves as a point of application of a compressive load, the compressive load being generated in a radial direction of the driving scroll by rotation of the driving scroll and the driven scroll,
  - an outer surface of the driving scroll body comes in contact with an inner surface of the driven scroll body at a first contact point in outermost peripheral portions of the driving scroll body and the driven scroll body, and an inner surface of the driving scroll body comes in contact with an outer surface of the driven scroll body at a second contact point in the outermost peripheral portions, and a direction perpendicular to an imaginary line connecting the first contact point and the second contact point serves as a load direction of the compressive load, and the load direction changes within a change range while the driving scroll and the driven scroll make one rotation, and the inverter circuit is arranged avoiding the change range in a circumferential direction of the driving scroll.

In the co-rotating scroll compressor, the compressive load acting primarily in the radial direction of the driving axis is generated by compression of refrigerant in the compression chamber.

Even in a scroll compressor including a fixed scroll and a movable scroll, the compressive load acts in the radial direction of a rotary shaft that orbits the movable scroll. The direction of the compressive load acting in the radial direction of the rotary shaft rotates and changes 360 degrees as the movable scroll rotates. In the following description, the compressive load refers to a compressive load acting in the radial direction of the driving scroll or the rotary shaft, unless otherwise specified.

In the co-rotating scroll compressor, the driving scroll and the driven scroll rotate eccentrically at the same angular velocity. The direction of the compressive load does not change significantly in the circumferential direction of the driving scroll while the compressor is in operation. That is, the range of the compressive load generated while the compressor is in operation is limited to a predetermined small angular range in the circumferential direction of the driving scroll. The present inventors focused on this point and achieved the present disclosure.

That is, when the direction of the compressive load rotates and changes 360 degrees as the movable scroll rotates, providing an inverter circuit on the outer peripheral surface of the housing always causes the compressive load to act over the whole angular range occupied by the inverter circuit in the circumferential direction every time the movable scroll makes one rotation. This may greatly amplify vibration of the housing caused by the compressive load.

In this regard, in the co-rotating scroll compressor of the present disclosure, the inverter circuit on the outer peripheral surface of the housing is arranged avoiding the defined change range in a circumferential direction of the driving scroll. This prevents the inverter circuit and the thin inverter case accommodating the inverter circuit and an inverter board from amplifying the vibration of the housing caused by the compressive load, thereby suppressing an increase in the noise.

Therefore, the co-rotating scroll compressor of the present disclosure includes the inverter circuit on the outer peripheral surface of the housing and is capable of suppressing vibration and noise caused by the compressive load acting in the radial direction of the driving scroll.

Preferably, the electric motor may include a stator that is fixed to the housing and a rotor that is rotatable together with the driving scroll inside the stator, the driving scroll may be disposed in the rotor, and the inverter circuit may be disposed on an outer periphery of the stator.

In this configuration, the inverter circuit is disposed on the outer periphery of the driving scroll. If the driving scroll and the inverter circuit are aligned in the radial direction of the driving scroll, the compressive load affecting the driving scroll and the driven scroll is likely to affect the housing and the inverter circuit disposed on the outer peripheral surface of the housing via components, such as bearings supporting the driving scroll and the driven scroll. This may remarkably cause the inverter circuit to amplify the vibration of the housing, but the present disclosure may solve this problem effectively.

Furthermore, the inverter circuit is disposed on the outer periphery of the stator, and this configuration is advantageous in simplifying the wiring structure for supplying power from the inverter circuit to the stator.

Furthermore, the driving scroll is disposed in the rotor, so that the stator, the rotor, and the inverter circuit are aligned with the driving scroll and the driven scroll in the radial direction of the driving scroll. This configuration allows the compressor to be compact in the direction of the driving axis compared to a configuration of the compressor in which the stator, the rotor, and the inverter circuit are aligned with the driving scroll and the driven scroll in the direction of the driving axis.

Advantageous Effects of the Invention

The co-rotating scroll compressor of the present disclosure includes an inverter circuit on an outer peripheral surface of a housing of the co-rotating scroll compressor and is capable of suppressing vibration and noise caused by a compressive load acting in a radial direction of a driving scroll.

DESCRIPTION OF EMBODIMENT

The following will describe an embodiment of the present disclosure in detail with reference to the accompanying drawings.

Embodiment

Figure 1:
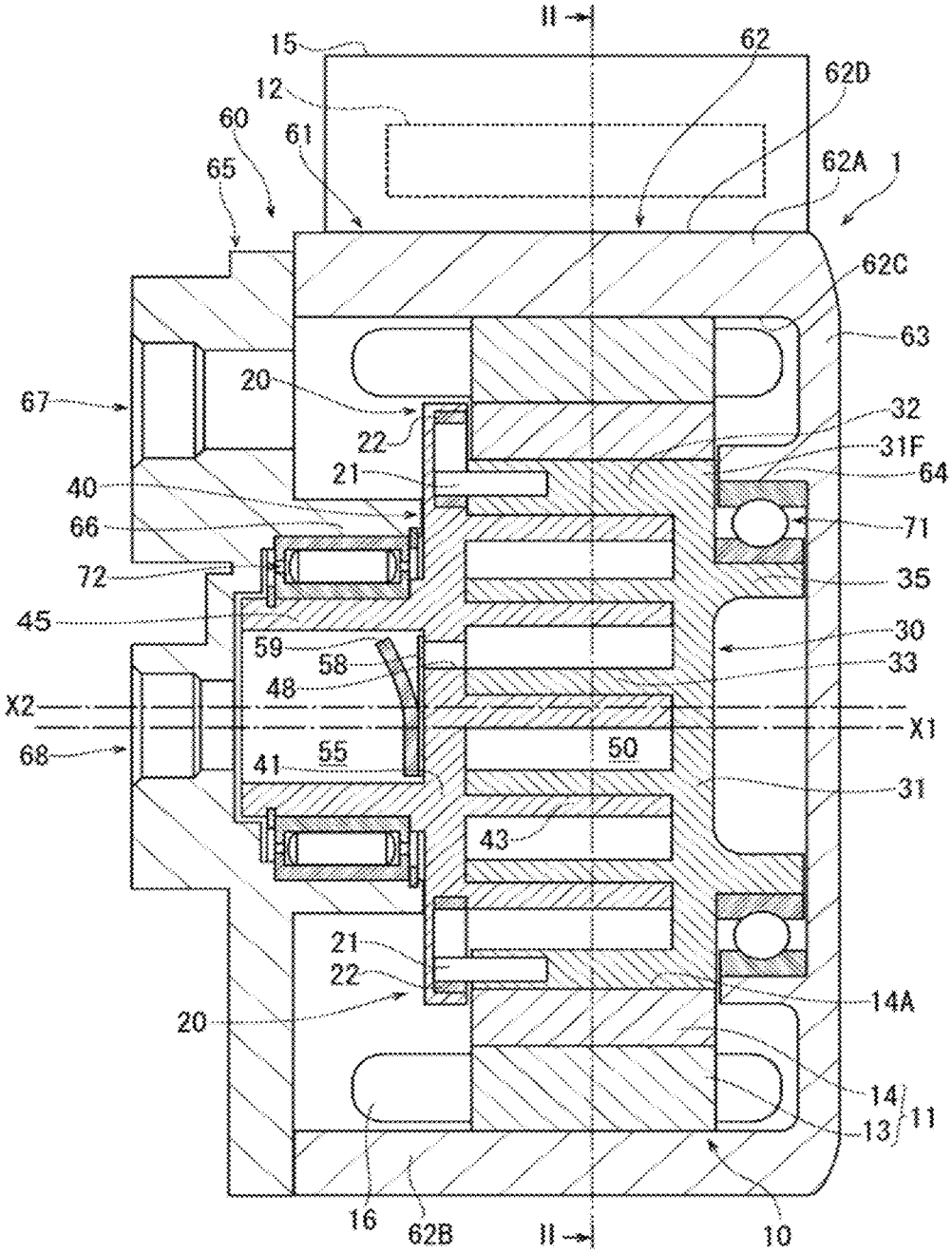
FIG. 1 is a schematic cross-sectional view of a co-rotating scroll compressor according to an embodiment, excluding an inverter case.

FIG. 1 illustrates a co-rotating scroll compressor 1 (hereinafter simply referred to as compressor 1) according to an embodiment of the present disclosure, which is an example of a specific embodiment of the present disclosure. The compressor 1 includes a housing 60. The housing 60 includes a housing body 61 and a cover 65.

The housing body 61 is a bottomed cylindrical member having an outer peripheral wall 62 and a bottom wall 63. The outer peripheral wall 62 has an inner peripheral surface 62C that has a cylindrical shape centered at a driving axis X1. The bottom wall 63 has a substantially circular plate shape and is perpendicular to the driving axis X1.

The outer peripheral edge of the bottom wall 63 is connected to the outer peripheral wall 62 at the proximal end of the outer peripheral wall 62 that is distant from the cover 65. The bottom wall 63 has a shaft support portion 64 that extends from a center portion of an inner surface of the bottom wall 63 and has a cylindrical shape centered at the driving axis X1. An outer ring of a bearing 71 is fitted into the shaft support portion 64.

The cover 65 has a substantially circular plate shape, and is perpendicular to the driving axis X1. The cover 65 is fastened to the outer peripheral wall 62 by bolts (not illustrated) with the outer peripheral edge of the cover 65 in contact with the distal end of the outer peripheral wall 62 of the housing body 61 to close the housing body 61.

The cover 65 has a shaft support portion 66 that extends from a center portion of an inner surface of the cover 65 and has a cylindrical shape centered at a driven axis X2. The driven axis X2 is eccentric to the driving axis X1 by a predetermined eccentric distance, and extends parallel to the driving axis X1. An outer ring of a needle bearing 72 is fitted into the shaft support portion 66.

The cover 65 has an inlet 67 and an outlet 68. The inlet 67 is located between the outer peripheral edge of the cover 65 and the shaft support portion 66, and extends through the cover 65 in a direction parallel to the driving axis X1. The outlet 68 is located at the center of the cover 65 and extends through the cover 65 in a direction parallel to the driving axis X1.

Figure 2:
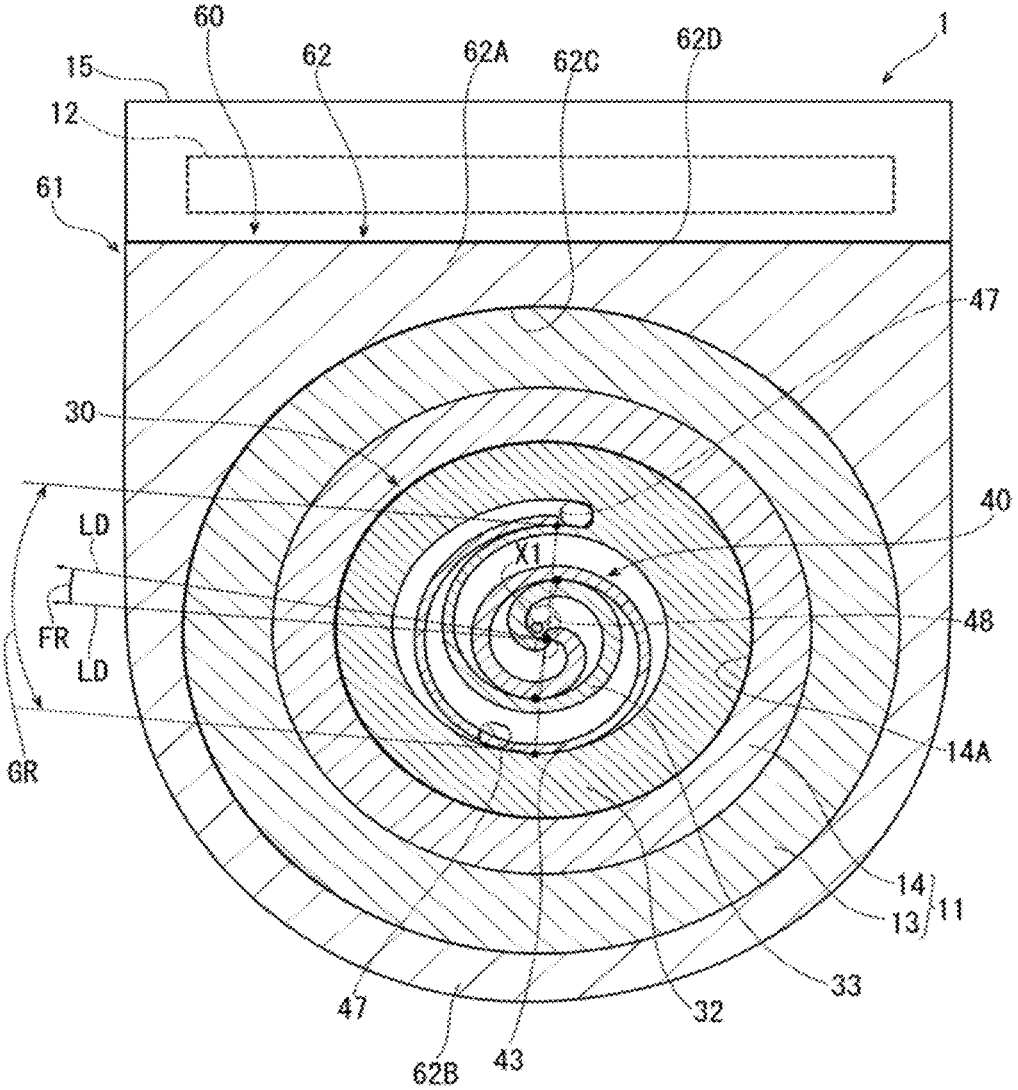
FIG. 2 is a cross-sectional view of the co-rotating scroll compressor taken along line II-II in FIG. 1.

As illustrated in FIGS. 1 and 2, the compressor 1 includes a driving mechanism 10, a driven mechanism 20, a driving scroll 30, and a driven scroll 40.

The driving mechanism 10 is configured to drive the driving scroll 30 to rotate about the driving axis X1 of the driving scroll 30. The driving mechanism 10 includes an electric motor 11, and an inverter circuit 12 for driving the electric motor 11. The electric motor 11 includes a stator 13 and a rotor 14.

The inverter circuit 12 is disposed on the outer peripheral surface of the cylindrical housing body 61, i.e., on the outer peripheral surface of the outer peripheral wall 62 of the housing 60. The inverter circuit 12 is accommodated in an inverter case 15. In the circumferential direction of the outer peripheral wall 62, the outer peripheral wall 62 consists of a thin area portion 62B; and a thick portion 62A to which the inverter case 15 is attached and which is thicker than the thin area portion 62B of the outer peripheral wall 62. The outer surface of the thick portion 62A is a flat surface 62D. The inverter case 15 is fixed to the flat surface 62D by a bolt (not illustrated). An inverter board of the inverter circuit 12 is disposed substantially parallel to the flat surface 62D.

As illustrated in FIG. 2, in the circumferential direction of the driving scroll 30 and the driven scroll 40, the inverter case 15 is disposed in a direction in which the driving axis X1 and the driven axis X2 are aligned, i.e., in a direction of a linear line connecting the driving axis X1 and the driven axis X2. Specifically, in the circumferential direction of the driving scroll 30 and the driven scroll 40, the inverter case 15 is disposed in an extending direction of an imaginary line VL, which will be described later. Although it will be described later, the inverter case 15 is arranged avoiding a change range FR of a load direction LD and a generation range GR of the compressive load in the circumferential direction of the driving scroll 30 and the driven scroll 40.

The stator 13 has a cylindrical shape centered at the driving axis X1, and has a winding wire 16. The stator 13 is fitted onto the inner peripheral surface 62C of the outer peripheral wall 62 of the housing body 61, so that the stator 13 is fixed to the housing 60 around the driving axis X1.

The rotor 14 has a cylindrical shape centered at the driving axis X1. The rotor 14 includes a plurality of permanent magnets (not illustrated) corresponding to the stator 13 and laminated steel plates (not illustrated) for fixing the permanent magnets. The rotor 14 is disposed inward of the stator 13, and is rotatable together with the driving scroll 30 inside the stator 13.

The rotor 14 accommodates the driving scroll 30. A driving scroll peripheral wall 32 of the driving scroll 30, which will be described later, is fitted onto the inner peripheral surface 14A of the rotor 14. This allows the rotor 14 to rotate together with the driving scroll 30. In this manner, the driving scroll 30 is driven rotatably about the driving axis X1 by the driving mechanism 10.

As illustrated in FIG. 1, the driving scroll 30 includes a driving scroll end plate 31, the driving scroll peripheral wall 32, and a driving scroll body 33.

The driving scroll end plate 31 has a substantially circular plate shape, and is perpendicular to the driving axis X1. The driving scroll end plate 31 has, on a surface of the driving scroll end plate 31 facing the bottom wall 63 of the housing body 61, a journal portion 35 that extends from a center portion of the surface of the driving scroll end plate 31 and has a cylindrical shape centered at the driving axis X1.

An inner ring of the bearing 71 is fitted onto the journal portion 35. This configuration allows the driving scroll 30 to be supported by the housing body 61 so as to be rotatable about the driving axis X1 in the housing 60.

The driving scroll peripheral wall 32 extends, in parallel with the driving axis X1, from an outer peripheral edge 31F of the driving scroll end plate 31 toward the driven scroll 40, and the driving scroll peripheral wall 32 has a cylindrical shape centered at the driving axis X1.

As illustrated in FIGS. 1 and 2, the driving scroll body 33 is located radially inward of the driving scroll peripheral wall 32 with respect to the driving axis X1. The driving scroll body 33 extends, in parallel with the driving axis X1, from the driving scroll end plate 31 toward the driven scroll 40, and the driving scroll body 33 has a spiral shape centered at the driving axis X1.

The driven scroll 40 has a driven scroll end plate 41 and a driven scroll body 43.

The driven scroll end plate 41 has a substantially circular plate shape, and is perpendicular to the driven axis X2. The driven scroll end plate 41 has, on a surface of the driven scroll end plate 41 facing the cover 65, a journal portion 45 that extends from a center portion of the surface of the driven scroll end plate 41 and has a cylindrical shape centered at the driven axis X2.

An inner ring of the needle bearing 72 is fitted onto the journal portion 45. This configuration allows the driven scroll 40 to be supported by the cover 65 so as to be rotatable about the driven axis X2 in the housing 60.

The driven scroll end plate 41 has suction ports 47 (see FIG. 2) and a discharge port 48.

The suction ports 47 are located radially outward of the outer peripheral surface of the shaft support portion 66 with respect to the driven axis X2, and extends through the driven scroll end plate 41 in a direction parallel to the driven axis X2. Specifically, two suction ports 47 are formed in the driven scroll end plate 41 with a phase difference of 180 degrees.

The discharge port 48 is located radially inward of the inner peripheral surface of the journal portion 45 with respect to the driven axis X2, and extends through the driven scroll end plate 41 in a direction parallel to the driven axis X2.

A space surrounded by the inner peripheral surface of the journal portion 45, the cover 65, and the driven scroll end plate 41 serves as a discharge chamber 55.

The driven scroll end plate 41 is provided with a discharge valve 58 for opening and closing the discharge port 48 and a retainer 59 for regulating the opening degree of the discharge valve 58, which are located in the discharge chamber 55.

As illustrated in FIGS. 1 and 2, the driven scroll body 43 extends, in parallel with the driven axis X2, from the driven scroll end plate 41 toward the driving scroll 30, and has a spiral shape centered at the driven axis X2.

The driving scroll 30 and the driven scroll 40 face each other, and the driving scroll body 33 and the driven scroll body 43 mesh with each other to form a plurality of compression chambers 50.

The driven mechanism 20 includes a plurality of pairs of a pin 21 and a ring 22 (three or more pairs if a pin-ring mechanism is adopted). The pairs of the pin 21 and the ring 22 transmit driving force from the driving scroll 30 to the driven scroll 40.

The pins 21 are cylindrical members, and are spaced from each other at an appropriate interval in the circumferential direction of the driving scroll 30 and protrude from the distal end of the driving scroll peripheral wall 32 toward the driven scroll end plate 41.

The rings 22 are disposed in the driven scroll end plate 41 and face the pins 21. The rings 22 are fitted into bottomed circular holes in the driven scroll end plate 41. The pins 21 are in contact with and configured to slide on the inner peripheral surface of the rings 22.

When the driving scroll 30 is driven rotatably about the driving axis X1 by the driving mechanism 10, each of the pins 21 slides on the inner peripheral surface of the corresponding ring 22 to rotate the ring 22 relatively about the center of the pin 21, thereby transmitting the torque of the driving scroll 30 to the driven scroll 40. The radius of turn of the ring 22 is equal to the eccentric distance of the driven axis X2 of the driven scroll 40 from the driving axis X1 of the driving scroll 30.

Accordingly, the driven scroll 40 is eccentric to the driving scroll 30 and is driven to follow the driving scroll 30 rotatably about the driven axis X2 of the driven scroll 40, which is parallel to the driving axis X1, by the driving scroll 30 and the driven mechanism 20. The driven scroll 40 orbits the driving axis X1 of the driving scroll 30, so that the driving scroll 30 and the driven scroll 40 change a volume of each of the compression chambers 50 by the rotational driving of the driving scroll 30 and the rotational following of the driven scroll 40.

Although not illustrated, the compressor 1 cooperates with an evaporator, an expansion valve, and a condenser to form a refrigeration circuit of a vehicle air conditioner. The evaporator is connected to the inlet 67 via a pipe. The condenser is connected to the outlet 68 via a pipe. The expansion valve is connected to the evaporator and the condenser via a pipe.

The refrigerant supplied from the evaporator flows into the housing 60 through the inlet 67, and is introduced into each compression chamber 50 via the suction port 47. The refrigerant is compressed in the compression chamber 50 to a discharge pressure, and discharged to the discharge chamber 55 through the discharge port 48, and emitted to the condenser through the outlet 68. In this manner, air conditioning is performed by the vehicle air conditioner.

Change Range of Load Direction

While the compressor 1 is in operation, the compressive load is generated in the compression chamber 50 in the radial direction of the driving scroll 30 by the rotation of the driving scroll 30 and the rotation of the driven scroll 40.

FIGS. 3 to 11 illustrate an imaginary plane perpendicular to the driving axis X1 and the driven axis X2. FIGS. 3 to 9 show a change of the load direction LD of the compressive load generated in the compression chamber 50 during approximately one rotation of the driving scroll 30 and the driven scroll 40 while the compressor 1 is in operation, the change being shown in increments of 60 degrees of the rotation angle.

Figure 3:
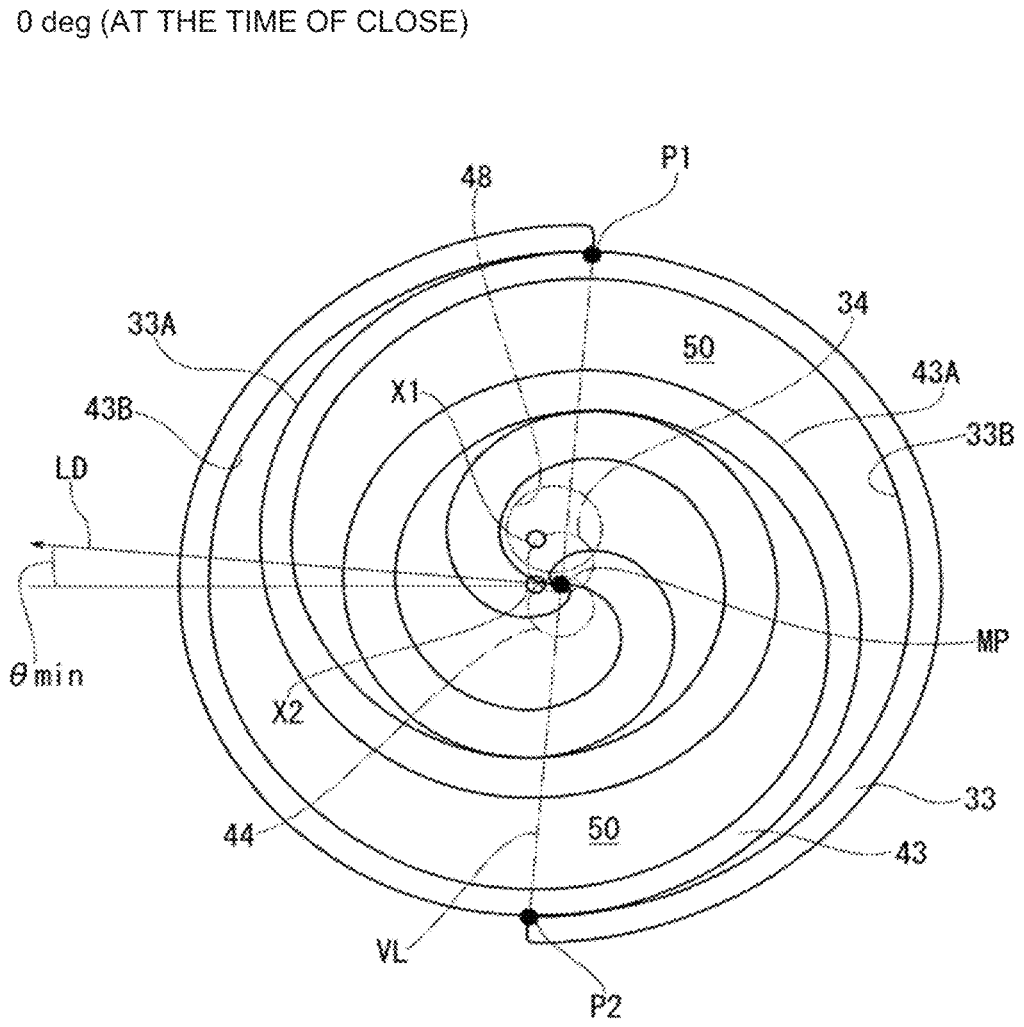
FIG. 3 is a schematic view of the co-rotating scroll compressor according to the embodiment, illustrating a load direction of a compressive load and a compression chamber formed in outermost peripheral portions of scrolls and closed (at a time of close).

FIGS. 3 to 11 are schematic views of the driving scroll body 33 of the driving scroll 30 and the driven scroll body 43 of the driven scroll 40 that substantially form the compression chambers 50. FIGS. 3 to 9 illustrate a driving scroll base circle (base circle of an involute curve) 34 of an outer surface 33A and an inner surface 33B of the driving scroll body 33, and a driven scroll 10) base circle (base circle of an involute curve) 44 of an outer surface 43A and an inner surface 43B of the driven scroll body 43. Of the circles indicated by the two-dot chain lines in each of the figures, the upper one is the driving scroll base circle 34, and the lower one is the driven scroll base circle 44. The center of the driving scroll base circle 34 is separated from the center of the driven scroll base circle 44 by a predetermined distance in a direction perpendicular to the driving axis X1. FIGS. 3 to 9 each illustrate three black circles, and the center one of the three black circles is a midpoint MP between the center of the driving scroll base circle 34 and the center of the driven scroll base circle 44. FIG. 3 illustrates two white circles, and the upper one and the lower one indicate the position of the driving axis X1 and the position of the driven axis X2, respectively. In FIGS. 4 to 9, the position of the driving axis X1 is illustrated, but the driven axis X2 is omitted.

FIG. 3 illustrates a state where the two compression chambers 50, 50, which are formed in an outermost peripheral portion of the compressor 1, are closed (at a time of close, 0 deg.). At this time, the outer surface 33A of the driving scroll body 33 comes in contact with the inner surface 43B of the driven scroll body 43 at a first contact point P1 in outermost peripheral portions of the scroll bodies 33, 43 and the inner surface 33B of the driving scroll body 33 comes in contact with the outer surface 43A of the driven scroll body 43 at a second contact point P2 in the outermost peripheral portions.

The first contact point P1 and the second contact point P2, at which the driving scroll body 33 comes in contact with the driven scroll body 43 in the outermost peripheral portions, are connected by an imaginary line VL. The length of the imaginary line VL may be regarded as a radial width of the whole compression chamber formed of the two compression chambers 50. That is, the midpoint MP can be regarded as the center of the whole compression chamber formed of the two compression chambers 50. A surface that includes the imaginary line VL and extends in the direction of the driving axis X1 and the driven axis X2 serves as a compressive load receiving surface. The midpoint MP between the center of the driving scroll base circle 34 and the center of the driven scroll base circle 44 serves as the point of application of the compressive load. The imaginary plane is perpendicular to the driving axis X1 and the driven axis X2, and a direction perpendicular to the imaginary line VL on the imaginary plane serves as the load direction (direction of action) LD of the compressive load.

The first contact point P1 is located on one of the tangent lines that contact the driving scroll base circle 34 and the driven scroll base circle 44. The second contact point P2 is located on the other of the tangent lines that contact the driving scroll base circle 34 and the driven scroll base circle 44. These tangent lines are parallel to the imaginary line VL.

Figure 4:
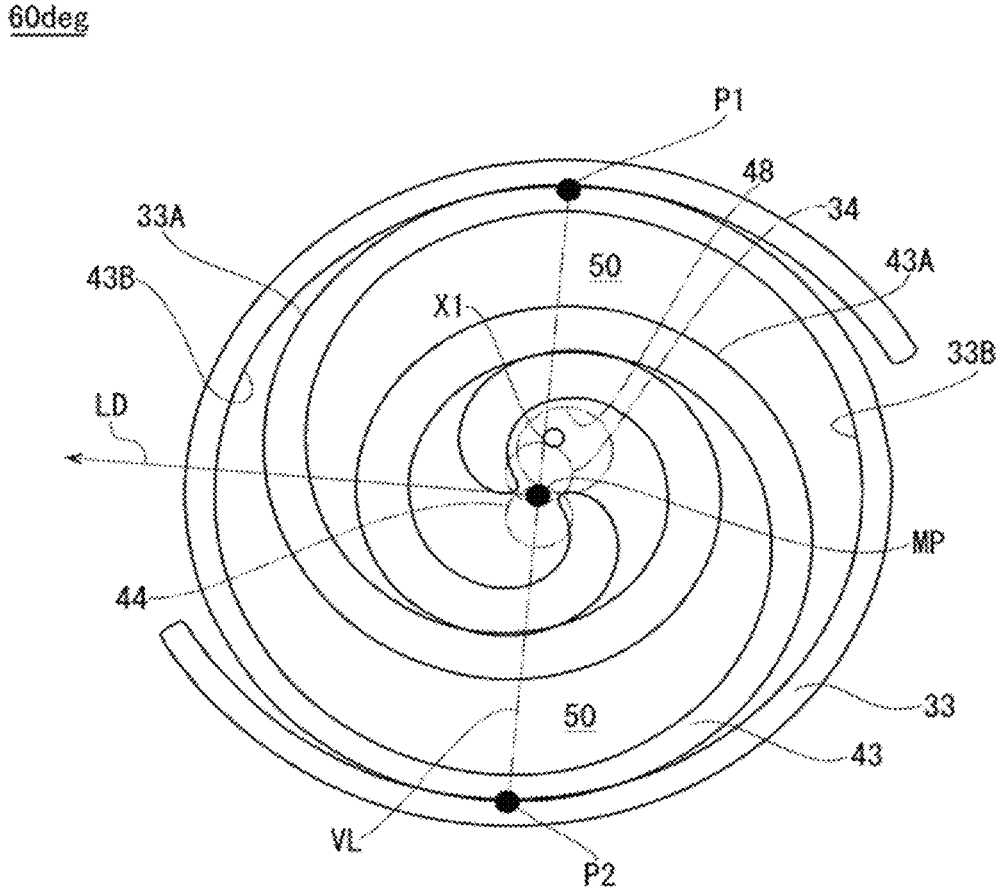
FIG. 4 is a schematic view of the co-rotating scroll compressor according to the embodiment, illustrating the load direction of the compressive load in a state where a driving scroll is rotated 60 degrees from the position of the driving scroll at a time of close.
Figure 5:
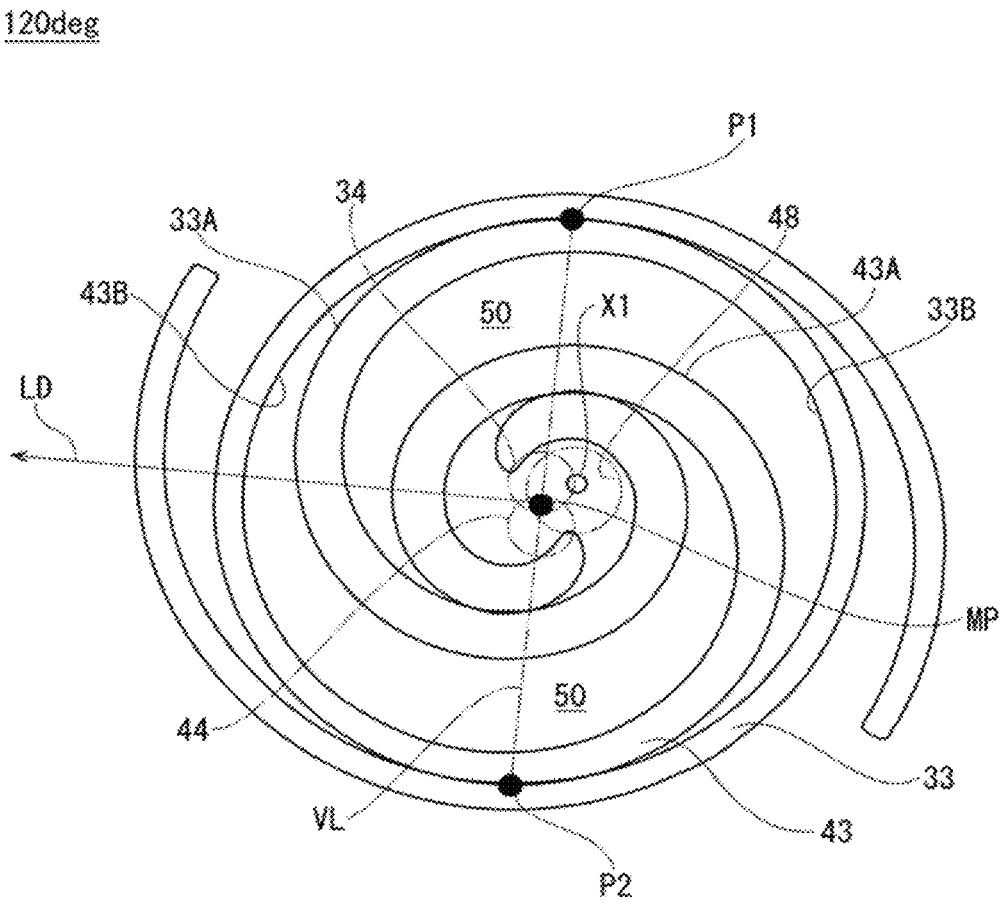
FIG. 5 is a schematic view of the co-rotating scroll compressor according to the embodiment, illustrating the load direction of the compressive load in a state where the driving scroll is rotated 120 degrees from the position of the driving scroll at a time of close.
Figure 6:
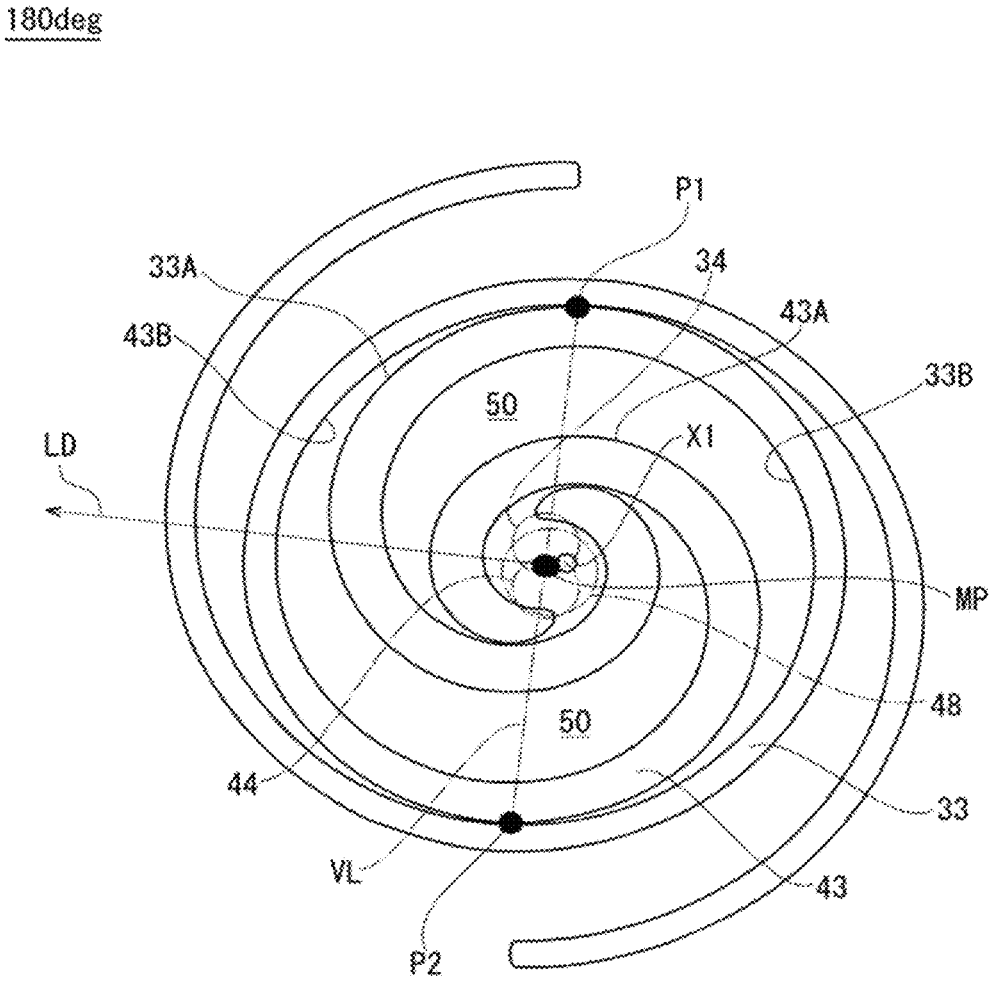
FIG. 6 is a schematic view of the co-rotating scroll compressor according to the embodiment, illustrating the load direction of the compressive load in a state where the driving scroll is rotated 180 degrees from the position of the driving scroll at a time of close.
Figure 7:
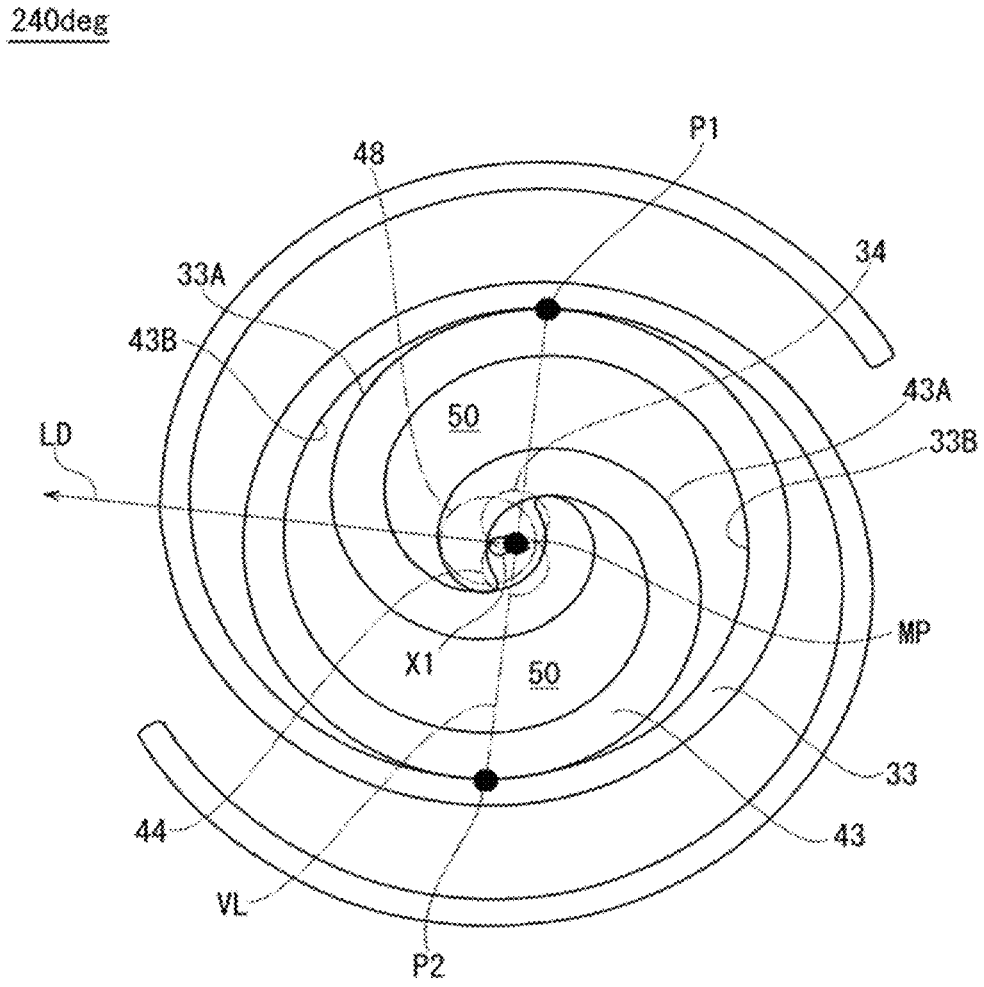
FIG. 7 is a schematic view of the co-rotating scroll compressor according to the embodiment, illustrating the load direction of the compressive load in a state where the driving scroll is rotated 240 degrees from the position of the driving scroll at a time of close.
Figure 8:
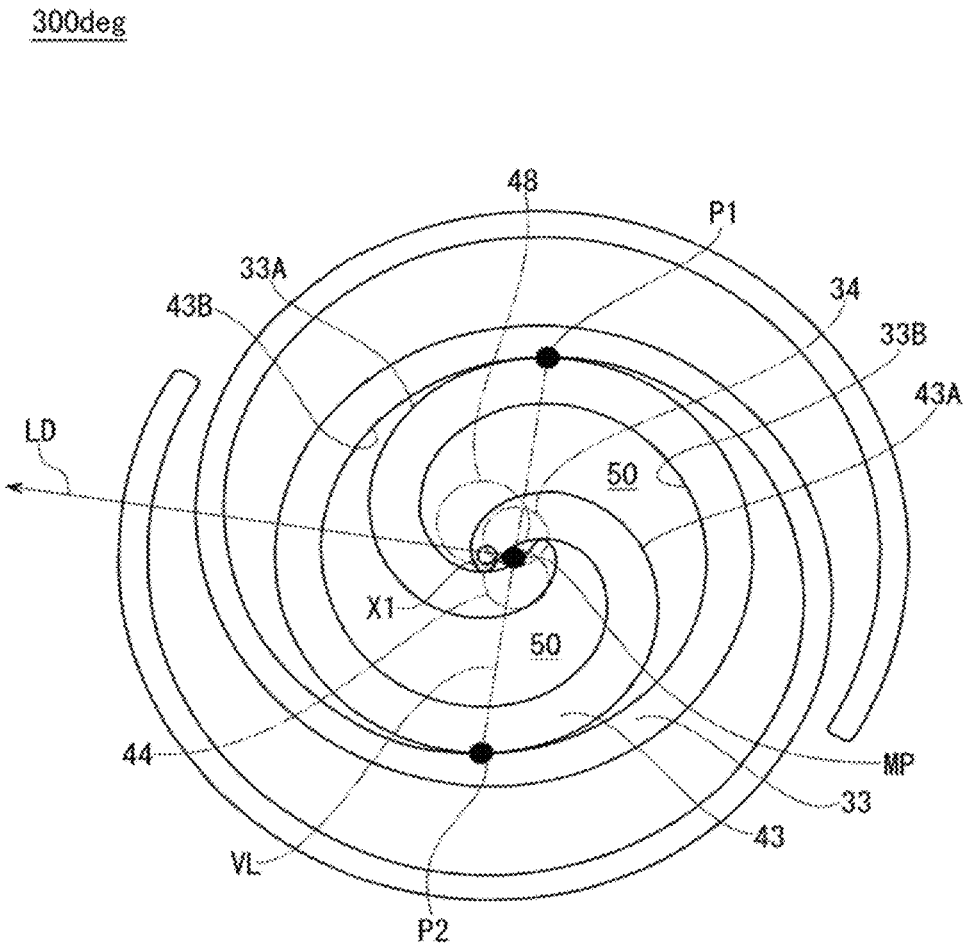
FIG. 8 is a schematic view of the co-rotating scroll compressor according to the embodiment, illustrating the load direction of the compressive load in a state where the driving scroll is rotated 300 degrees from the position of the driving scroll at a time of close.
Figure 9:
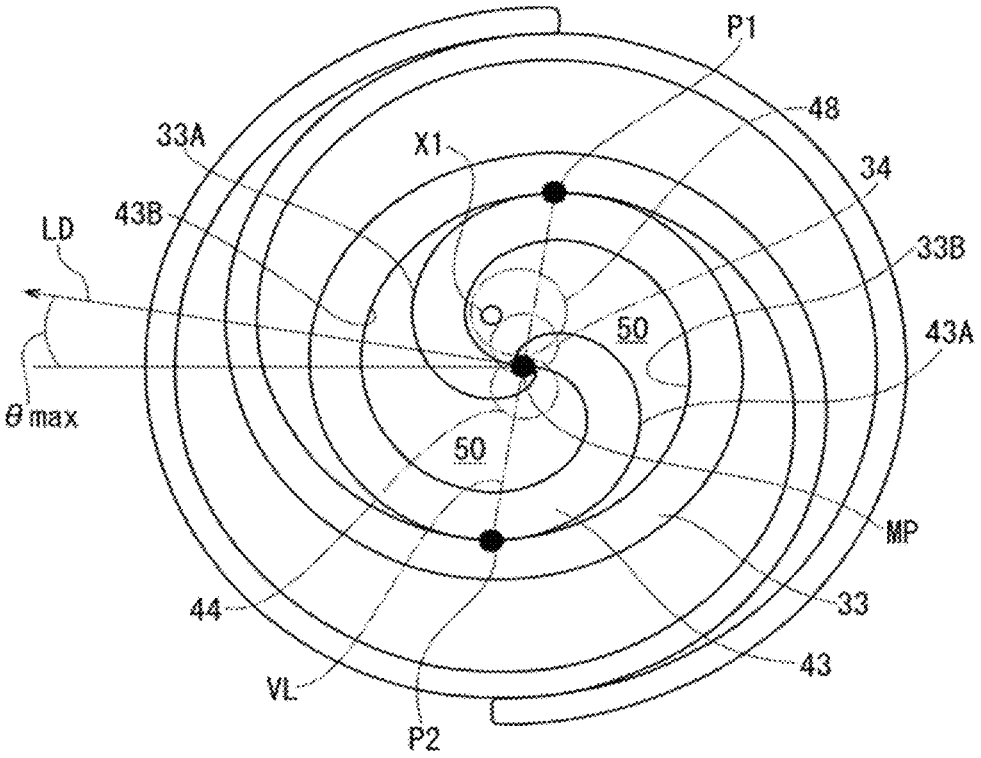
FIG. 9 is a schematic view of the co-rotating scroll compressor according to the embodiment, illustrating the load direction of the compressive load in a state immediately before the driving scroll is rotated 360 degrees from the position of the driving scroll at a time of close.

FIG. 4 illustrates the state where the driving scroll 30 is rotated 60 degrees from the position of the driving scroll 30 at the time of close. FIG. 5 illustrates the state where the driving scroll 30 is rotated 120 degrees from the position of the driving scroll 30 at the time of close. FIG. 6 illustrates the state where the driving scroll 30 is rotated 180 degrees from the position of the driving scroll 30 at the time of close. FIG. 7 illustrates the state where the driving scroll 30 is rotated 240 degrees from the position of the driving scroll 30 at the time of close. FIG. 8 illustrates the state where the driving scroll 30 is rotated 300 degrees from the position of the driving scroll 30 at the time of close. FIG. 9 illustrates the state immediately before the driving scroll 30 is rotated 360 degrees from the position of the driving scroll 30 at the time of close.

As illustrated in FIGS. 4 to 9, the first contact point P1 and the second contact point P2 are displaced radially inward of the driving scroll 30 and the driven scroll 40 as the driving scroll 30 and the driven scroll 40 rotate. Accordingly, the length of the imaginary line VL, i.e., the radial width of the whole compression chamber formed of the two compression chambers 50, gradually decreases.

The driving axis X1 of the driving scroll 30 is eccentric to the driven axis X2 of the driven scroll 40 by the predetermined eccentric distance. The first contact point P1 and the second contact point P2 move as the driving scroll 30 and the driven scroll 40 rotate, so that the load direction LD of the compressive load with the midpoint MP as the point of application changes. The range in which the load direction LD changes while the driving scroll 30 and the driven scroll 40 make one rotation serves as the change range FR.

In FIGS. 3 to 9, an angle of the load direction LD with respect to an imaginary horizontal line is defined as a load angle θ. The load angle θ becomes a minimum load angle θmin at the time of close as illustrated in FIG. 3, and becomes a maximum load angle θmax immediately before the driving scroll 30 is rotated 360 degrees from the position of the driving scroll 30 at the time of close as illustrated in FIG. 9.

Figure 10:
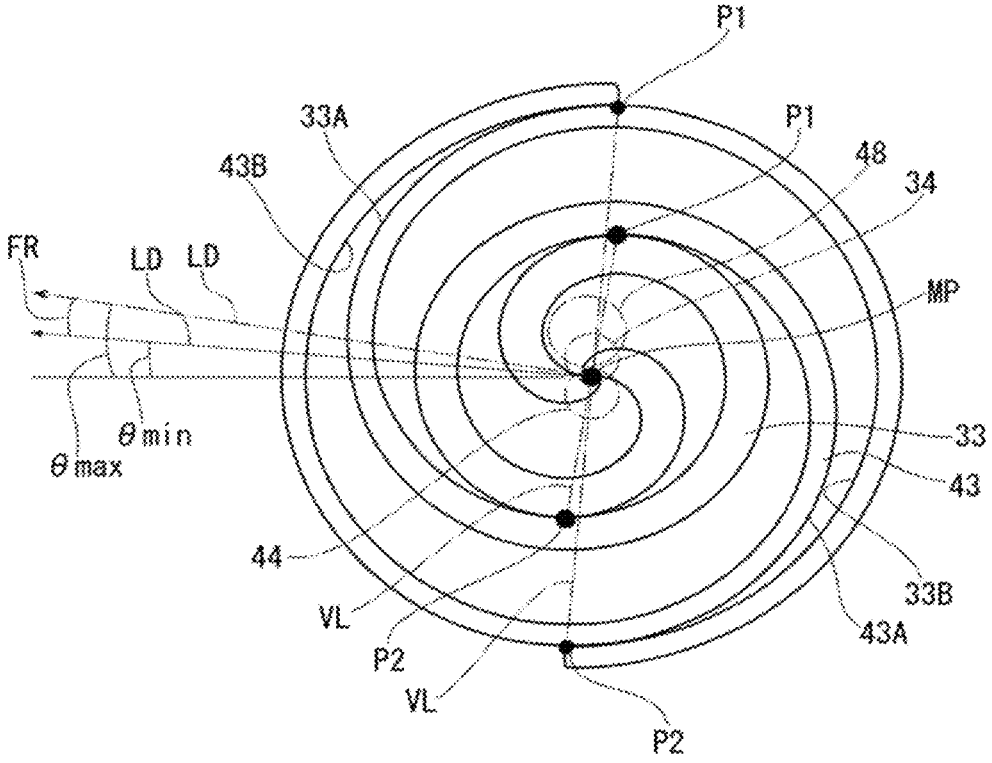
FIG. 10 is a schematic view of the co-rotating scroll compressor according to the embodiment, illustrating a change range of the load direction of the compressive load.

As illustrated in FIG. 10, the change range FR of the load direction LD is a range of the difference between the minimum load angle θmin and the maximum load angle θmax. In FIG. 10, the load direction LD at the time of close is indicated by a solid arrow, and the load direction LD at the time immediately before the driving scroll 30 is rotated 360 degrees from the position of the driving scroll 30 at the time of close is indicated by a two-dot chain line.

Generation Range of Compressive Load

The two compression chambers 50 become maximum at the time of close illustrated in FIG. 3. At this time, the range of the compressive load, which is generated in the compression chamber 50, becomes maximum in the radial direction of the driving scroll 30 and the driven axis X2, that is, on the imaginary plane perpendicular to the driving axis X1 and the driven scroll 40.

Figure 11:
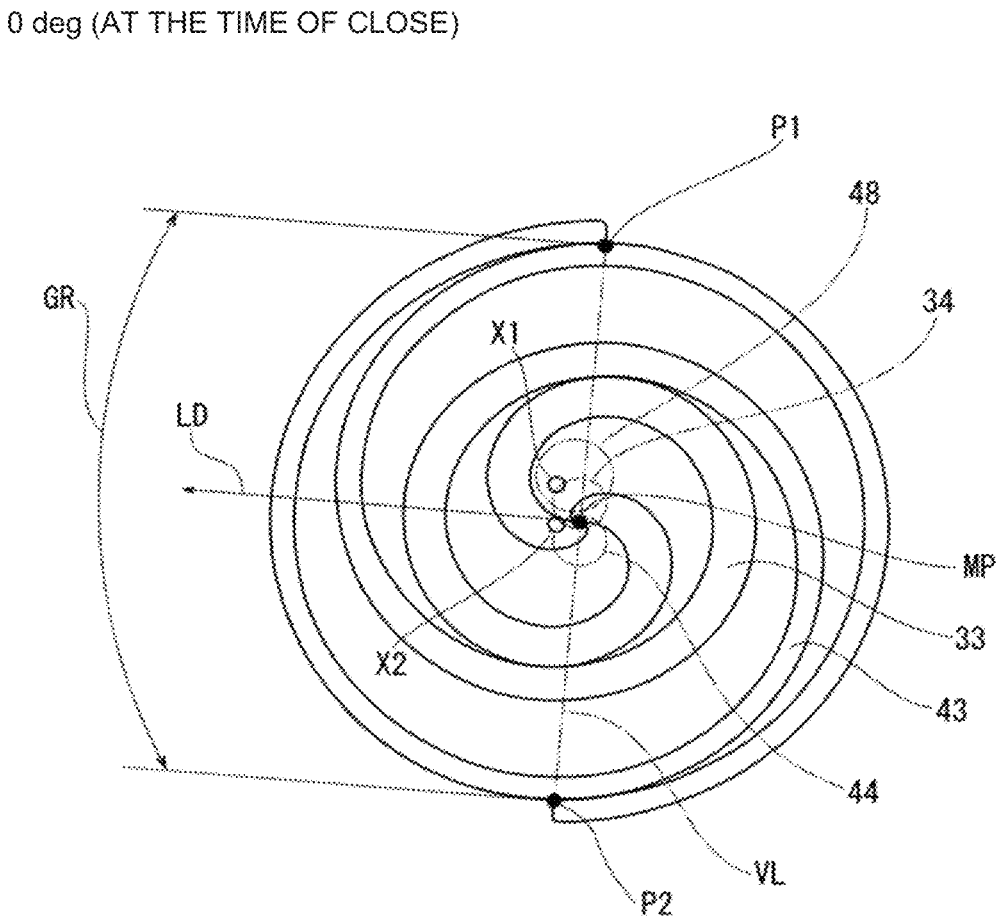
FIG. 11 is a schematic view of the co-rotating scroll compressor according to the embodiment, illustrating a generation range of the compressive load.

FIG. 11 illustrates the generation range GR of the compressive load, which has a width equal to a distance between the first contact point P1 and the second contact point P2 at the time of close, i.e., the length of the imaginary line VL, and extends in the load direction LD at the time of close.

In the compressor 1, as illustrated in FIG. 2, the inverter case 15 accommodating the inverter circuit 12 is arranged avoiding the change range FR of the load direction LD and the generation range GR of the compressive load in the circumferential direction of the driving scroll 30 and the driven scroll 40.

Advantageous Effects

As previously described, in the compressor 1 according to the embodiment, the inverter case 15 on the outer peripheral wall 62 of the housing body 61 is arranged avoiding the change range FR of the load direction LD in the circumferential direction of the driving scroll 30 and the driven scroll 40. The load direction LD of the compressive load, whose point of application is the midpoint MP between the center of the driving scroll base circle 34 and the center of the driven scroll base circle 44, is the direction of the compressive load acting on the outside of the compression chambers 50 with respect to the center of the whole compression chamber formed of the two compression chambers 50. The arrangement of the inverter case 15 avoiding the change range FR in which the load direction LD changes while the compressor 1 is in operation prevents the compressive load, which is generated in the compression chambers 50, from affecting the inverter case 15.

The distance between the first contact point P1 and the second contact point P2, i.e., the length of the imaginary line VL, may be regarded as the radial width of the whole compression chamber formed of the two compression chambers. The whole compression chamber formed of the two compression chambers 50 becomes maximum at the time of close. The distance between the first contact point P1 and the second contact point P2 at the time of close, i.e., the length of the imaginary line VL, may be regarded as the maximum radial width of the whole compression chamber formed of the two compression chambers 50. The arrangement of the inverter case 15 avoiding the generation range GR, which has a width equal to the distance between the first contact point P1 and the second contact point P2 (i.e., the length of the imaginary line VL) at the time of close and extends in the load direction LD at the time of close, further prevents the compressive load generated in the compression chamber 50 from affecting the inverter case 15.

Accordingly, the compressor 1 according to the embodiment is capable of preventing the inverter circuit 12 and the inverter case 15 from amplifying the vibration of the housing 60 caused by the compressive load generated in the compression chamber 50, thereby suppressing an increase in the noise.

This allows the co-rotating scroll compressor 1 according to the embodiment to include the inverter circuit 12 on the outer peripheral surface of the housing 60 and to suppress vibration and noise caused by the compressive load acting in the radial direction of driving scroll.

In the compressor 1, the driving scroll 30 and the driven scroll 40 are disposed in the electric motor 11 accommodated in the housing 60, and the inverter case 15 accommodating the inverter circuit 12 is disposed outward of the driving scroll 30 and the driven scroll 40, i.e., radially outward of the driving scroll 30 and the driven scroll 40 around the driving axis X1.

In this configuration, the inverter case 15 is disposed on the outer periphery of the driving scroll 30. If the driving scroll 30 and the inverter case 15 are aligned in the radial direction of the driving scroll 30, the compressive load affecting the driving scroll 30 and the driven scroll 40 is likely to affect the housing 60 and the inverter case 15 and inverter circuit 12 disposed on the outer peripheral surface of the housing 60 via components, such as the bearings supporting the driving scroll 30 and the driven scroll 40. This may remarkably cause the inverter circuit 12 and the inverter case 15 to amplify the vibration of the housing 60, but the compressor 1 may solve this problem effectively.

Furthermore, the inverter circuit 12 is disposed on the outer periphery of the stator 13, and this configuration is advantageous in simplifying the wiring structure for supplying power from the inverter circuit 12 to the stator 13.

Furthermore, the electric motor 11 and the inverter case 15 are aligned with the driving scroll 30 and the driven scroll 40 in the radial direction of the driving scroll 30, so that the compressor 1 may become compact in the direction of the driving axis X1 compared to a configuration of the compressor in which the electric motor 11 and the inverter case 15 are aligned with the driving scroll 30 and the driven scroll 40 in the direction of the driving axis X1.

Although the present disclosure has been described based on the above embodiment, the present disclosure is not limited to the above embodiment, and may be modified within the scope of the present disclosure.

According to the embodiment, in the circumferential direction of the driving scroll 30 and the driven scroll 40, the inverter circuit 12 and the inverter case 15 are disposed in the direction of a linear line connecting the driving axis X1 and the driven axis X2 or in the extending direction of the imaginary line VL, and the inverter circuit 12 is disposed on such lines so as to be substantially perpendicular to such lines; however, the present disclosure is not limited to this configuration. That is, the center of the inverter circuit 12 in the circumferential direction of the driving scroll 30 may be disposed in the direction of the linear line connecting the driving scroll 30 and the driven axis X2 or on the imaginary line VL. The position and angle of the inverter circuit 12 in the circumferential direction of the driving axis X1 may be determined as appropriate, but have to be determined so as to avoid the change range FR of the load direction LD.

According to the embodiment, the electric motor 11 and the inverter circuit 12 are aligned with the driving scroll 30 and the driven scroll 40 in the radial direction of the driving scroll 30, but the present disclosure is not limited to this configuration. For example, the electric motor 11 may be aligned with the driving scroll 30 and the driven scroll 40 in the direction of the driving axis X1, and the inverter circuit 12 may be disposed on the outer peripheral surface of the housing 60 at a position corresponding to the position of the electric motor 11. Alternatively, the electric motor 11 may be aligned with the driving scroll 30 and the driven scroll 40 in the radial direction of the driving scroll 30, but the inverter circuit 12 may be disposed on the outer peripheral surface of the housing 60 at a position displaced from the position of the electric motor 11 in the direction of the driving axis X1.

According to the embodiment, each of the driving scroll body 33 and the driven scroll body 43 has approximately two-turns spiral shape, but the present disclosure is not limited thereto. For example, the driving scroll body 33 and the driven scroll body 43 may have more turns of spiral shape so as to increase the number of compression chambers 50. Alternatively, the driving scroll body 33 and the driven scroll body 43 may have different number of turns of spiral shape. This configuration also allows the two compression chambers 50 to be closed in the outermost peripheral portions at the time of close (0 deg.).

The change range FR according to the embodiment is defined by the minimum load angle θmin at the time of close and the maximum load angle θmax immediately before the driving scroll 30 is rotated 360 degrees from the position of the driving scroll 30 at the time of close, but the load direction LD may become the minimum load angle θmin at a time different from the time of close and may become the maximum load angle θmax at a time not immediately before the driving scroll 30 is rotated 360 degrees from the position of the driving scroll 30 at the time of close, depending on the shapes of the scrolls.

According to the embodiment, the driven mechanism 20 includes the pins 21 and the rings 22, but the present disclosure is not limited thereto. For example, the driven mechanism 20 may be formed by a pin-ring-pin mechanism in which two pins slide on an inner peripheral surface of one free ring, a pin-and-pin mechanism in which outer peripheral surfaces of two pins slide on each other, a mechanism using Oldham's shaft coupling, or the like.

The embodiment of the present disclosure has been described above, and the technical ideas that can be understood from the above embodiment will be described below.

Note 1

A co-rotating scroll compressor comprising:

a driving mechanism; a driving scroll; a driven mechanism; a driven scroll; and a housing having a cylindrical shape, wherein the driving scroll is accommodated in the housing and driven rotatably about a driving axis of the driving scroll by the driving mechanism, wherein the driven scroll is accommodated in the housing, eccentric to the driving scroll, and follows the driving scroll rotatably about a driven axis of the driven scroll by the driving scroll and the driven mechanism, wherein the driving scroll has: a driving scroll end plate extending in a direction intersecting the driving axis;

and a driving scroll body protruding from the driving scroll end plate toward the driven scroll and having a spiral shape, wherein the driven scroll has: a driven scroll end plate extending in a direction intersecting the driven axis; and a driven scroll body protruding from the driven scroll end plate toward the driving scroll and having a spiral shape, wherein the driving scroll and the driven scroll face each other, the driving scroll body and the driven scroll body forming a compression chamber, the driving scroll and the driven scroll being configured to change a volume of the compression chamber by rotational driving of the driving scroll and rotational following of the driven scroll, wherein the driving mechanism includes: an electric motor accommodated in the housing; and an inverter circuit for driving the electric motor, the inverter circuit being disposed on an outer peripheral surface of the housing, wherein on an imaginary plane perpendicular to the driving axis, a midpoint between a center of a driving scroll base circle of the driving scroll body and a center of a driven scroll base circle of the driven scroll body serves as a point of application of a compressive load, the compressive load being generated in a radial direction of the driving scroll by rotation of the driving scroll and the driven scroll, and at a time when the compression chamber formed in outermost peripheral portions of the driving scroll body and the driven scroll body is closed, an outer surface of the driving scroll body comes in contact with an inner surface of the driven scroll body at a first contact point in the outermost peripheral portions of the driving scroll body and the driven scroll body, and an inner surface of the driving scroll body comes in contact with an outer surface of the driven scroll body at a second contact point in the outermost peripheral portions, and a direction perpendicular to an imaginary line connecting the first contact point and the second contact point serves as a load direction of the compressive load, and the inverter circuit is arranged avoiding a range that has a width equal to a distance between the first contact point and the second contact point and extends in the load direction LD in a circumferential direction of the driving scroll.

Note 2

A co-rotating scroll compressor comprising:

a driving mechanism; a driving scroll; a driven mechanism; a driven scroll; and a housing having a cylindrical shape, wherein the driving scroll is accommodated in the housing and driven rotatably about a driving axis of the driving scroll by the driving mechanism, wherein the driven scroll is accommodated in the housing, eccentric to the driving scroll, and follows the driving scroll rotatably about a driven axis of the driven scroll by the driving scroll and the driven mechanism, wherein the driving scroll has: a driving scroll end plate extending in a direction intersecting the driving axis; and a driving scroll body protruding from the driving scroll end plate toward the driven scroll and having a spiral shape, wherein the driven scroll has: a driven scroll end plate extending in a direction intersecting the driven axis; and a driven scroll body protruding from the driven scroll end plate toward the driving scroll and having a spiral shape, wherein the driving scroll and the driven scroll face each other, the driving scroll body and the driven scroll body forming a compression chamber, the driving scroll and the driven scroll being configured to change a volume of the compression chamber by rotational driving of the driving scroll and rotational following of the driven scroll, wherein the driving mechanism includes: an electric motor accommodated in the housing; and an inverter circuit for driving the electric motor, the inverter circuit being disposed on an outer peripheral surface of the housing, and wherein on an imaginary plane perpendicular to the driving axis, a linear line connects the driving axis and the driven axis, and in the circumferential direction of the driving scroll, the inverter circuit is disposed on the linear line.

Note 3

A co-rotating scroll compressor comprising:

a driving mechanism; a driving scroll; a driven mechanism; a driven scroll; and a housing having a cylindrical shape, wherein the driving scroll is accommodated in the housing and driven rotatably about a driving axis of the driving scroll by the driving mechanism, wherein the driven scroll is accommodated in the housing, eccentric to the driving scroll, and follows the driving scroll rotatably about a driven axis of the driven scroll by the driving scroll and the driven mechanism, wherein the driving scroll has: a driving scroll end plate extending in a direction intersecting the driving axis; and a driving scroll body protruding from the driving scroll end plate toward the driven scroll and having a spiral shape, wherein the driven scroll has: a driven scroll end plate extending in a direction intersecting the driven axis; and a driven scroll body protruding from the driven scroll end plate toward the driving scroll and having a spiral shape, wherein the driving scroll and the driven scroll face each other, the driving scroll body and the driven scroll body forming a compression chamber, the driving scroll and the driven scroll being configured to change a volume of the compression chamber by rotational driving of the driving scroll and rotational following of the driven scroll, wherein the driving mechanism includes: an electric motor accommodated in the housing; and an inverter circuit for driving the electric motor, the inverter circuit being disposed on an outer peripheral surface of the housing, wherein on an imaginary plane perpendicular to the driving axis, at a time when the compression chamber formed in outermost peripheral portions of the driving scroll body and the driven scroll body is closed, an outer surface of the driving scroll body comes in contact with an inner surface of the driven scroll body at a first contact point in the outermost peripheral portions of the driving scroll body and the driven scroll body, and an inner surface of the driving scroll body comes in contact with an outer surface of the driven scroll body at a second contact point in the outermost peripheral portions, and an imaginary line connects the first contact point and the second contact point, and in the circumferential direction of the driving scroll, the inverter circuit is disposed on the imaginary line.

Note 4

The co-rotating scroll compressor according to Note 2 or 3, wherein in the circumferential direction of the driving scroll, a center of the inverter circuit is disposed on the linear line or on the imaginary line.

INDUSTRIAL APPLICABILITY

The present disclosure is applicable to a device, such as an air conditioner for a vehicle.

REFERENCE SIGNS LIST

1 co-rotating scroll compressor
10 driving mechanism
11 electric motor
12 inverter circuit
13 stator
14 rotor
20 driven mechanism
30 driving scroll
31 driving scroll end plate
33 driving scroll body
34 driving scroll base circle
40 driven scroll
41 driven scroll end plate
43 driven scroll body
44 driven scroll base circle
50 compression chamber
60 housing
X1 driving axis
X2 driven axis
MP midpoint
P1 first contact point
P2 second contact point
VL imaginary line
LD load direction
FR change range

The invention claimed is:

1. A co-rotating scroll compressor comprising:

a driving mechanism;

a driving scroll;

a driven mechanism;

a driven scroll; and a housing having a cylindrical shape, wherein the driving scroll is accommodated in the housing and driven rotatably about a driving axis of the driving scroll by the driving mechanism, wherein the driven scroll is accommodated in the housing, eccentric to the driving scroll, and follows the driving scroll rotatably about a driven axis of the driven scroll by the driving scroll and the driven mechanism, wherein the driving scroll has: a driving scroll end plate extending in a direction intersecting the driving axis; and a driving scroll body protruding from the driving scroll end plate toward the driven scroll and having a spiral shape, wherein the driven scroll has: a driven scroll end plate extending in a direction intersecting the driven axis; and a driven scroll body protruding from the driven scroll end plate toward the driving scroll and having a spiral shape, wherein the driving scroll and the driven scroll face each other, the driving scroll body and the driven scroll body forming a compression chamber, the driving scroll and the driven scroll being configured to change a volume of the compression chamber by rotational driving of the driving scroll and rotational following of the driven scroll, wherein the driving mechanism includes: an electric motor accommodated in the housing; and an inverter circuit for driving the electric motor, the inverter circuit being accommodated in an inverter case that is disposed on an outer peripheral surface of the housing, wherein on an imaginary plane perpendicular to the driving axis, a midpoint between a center of a driving scroll base circle of the driving scroll body and a center of a driven scroll base circle of the driven scroll body serves as a point of application of a compressive load, the compressive load being generated in a radial direction of the driving scroll by rotation of the driving scroll and the driven scroll, an outer surface of the driving scroll body comes in contact with an inner surface of the driven scroll body at a first contact point in outermost peripheral portions of the driving scroll body and the driven scroll body, and an inner surface of the driving scroll body comes in contact with an outer surface of the driven scroll body at a second contact point in the outermost peripheral portions, and a direction perpendicular to an imaginary line connecting the first contact point and the second contact point serves as a load direction of the compressive load, and the load direction changes within a change range while the driving scroll and the driven scroll make one rotation, the inverter circuit is arranged avoiding the change range in a circumferential direction of the driving scroll, and the inverter circuit is disposed at a position that overlaps the housing in the circumferential direction of the driving scroll so as to be radially outward of the driving scroll.

2. A co-rotating scroll compressor comprising:

a driving mechanism;

a driving scroll;

a driven mechanism; a driven scroll; and a housing having a cylindrical shape, wherein the driving scroll is accommodated in the housing and driven rotatably about a driving axis of the driving scroll by the driving mechanism, wherein the driven scroll is accommodated in the housing, eccentric to the driving scroll, and follows the driving scroll rotatably about a driven axis of the driven scroll by the driving scroll and the driven mechanism, wherein the driving scroll has: a driving scroll end plate extending in a direction intersecting the driving axis; and a driving scroll body protruding from the driving scroll end plate toward the driven scroll and having a spiral shape, wherein the driven scroll has: a driven scroll end plate extending in a direction intersecting the driven axis; and a driven scroll body protruding from the driven scroll end plate toward the driving scroll and having a spiral shape, wherein the driving scroll and the driven scroll face each other, the driving scroll body and the driven scroll body forming a compression chamber, the driving scroll and the driven scroll being configured to change a volume of the compression chamber by rotational driving of the driving scroll and rotational following of the driven scroll, wherein the driving mechanism includes: an electric motor accommodated in the housing; and an inverter circuit for driving the electric motor, the inverter circuit being accommodated in an inverter case that is disposed on an outer peripheral surface of the housing, wherein on an imaginary plane perpendicular to the driving axis, a midpoint between a center of a driving scroll base circle of the driving scroll body and a center of a driven scroll base circle of the driven scroll body serves as a point of application of a compressive load, the compressive load being generated in a radial direction of the driving scroll by rotation of the driving scroll and the driven scroll, an outer surface of the driving scroll body comes in contact with an inner surface of the driven scroll body at a first contact point in outermost peripheral portions of the driving scroll body and the driven scroll body, and an inner surface of the driving scroll body comes in contact with an outer surface of the driven scroll body at a second contact point in the outermost peripheral portions, and a direction perpendicular to an imaginary line connecting the first contact point and the second contact point serves as a load direction of the compressive load, and the load direction changes within a change range while the driving scroll and the driven scroll make one rotation, and the inverter circuit is arranged avoiding the change range in a circumferential direction of the driving scroll, wherein the electric motor includes: a stator that is fixed to the housing; and a rotor that is rotatable together with the driving scroll inside the stator, the driving scroll is disposed in the rotor, and the inverter circuit is disposed on an outer periphery of the stator.

* * * * *